US011877590B2

(12) United States Patent
Gessesse

(10) Patent No.: US 11,877,590 B2
(45) Date of Patent: Jan. 23, 2024

(54) SMOKELESS TOBACCO COMPOSITION

(71) Applicant: Fiedler & Lundgren AB, Malmo (SE)

(72) Inventor: Andinet Amare Gessesse, Malmo (SE)

(73) Assignee: FIEDLER & LUNDGREN AB, Malmo (SE)

( * ) Notice: Subject to any disclaimer, the term of this patent is extended or adjusted under 35 U.S.C. 154(b) by 752 days.

(21) Appl. No.: 16/366,069

(22) Filed: Mar. 27, 2019

(65) Prior Publication Data

US 2020/0305496 A1 Oct. 1, 2020

(51) Int. Cl.
*A24B 13/00* (2006.01)
*A24B 3/18* (2006.01)
*A24B 15/42* (2006.01)

(52) U.S. Cl.
CPC ..... *A24B 13/00* (2013.01); *A24B 3/18* (2013.01); *A24B 15/42* (2013.01)

(58) Field of Classification Search
CPC ..... A24B 13/00; A24B 3/18; A24B 15/42
See application file for complete search history.

(56) References Cited

U.S. PATENT DOCUMENTS

| | | | | |
|---|---|---|---|---|
| 1,437,095 | A | 11/1922 | Alwin et al. | |
| 2,008,892 | A | 7/1935 | Arthur et al. | |
| 3,845,774 | A | 11/1974 | Tso et al. | |
| 4,817,640 | A | 4/1989 | Summers | |
| 5,360,024 | A | 11/1994 | Greig | |
| 6,058,940 | A | 5/2000 | Lane | |
| 6,325,859 | B1 | 12/2001 | De Roos et al. | |
| 6,436,461 | B1 | 8/2002 | Bouwmeesters et al. | |
| 9,775,376 | B2 | 10/2017 | Cantrell et al. | |
| 2004/0112394 | A1 | 6/2004 | Krukonis et al. | |
| 2005/0244521 | A1 | 11/2005 | Strickland et al. | |
| 2006/0191548 | A1 | 8/2006 | Strickland et al. | |
| 2007/0000506 | A1 | 1/2007 | Streck | |
| 2007/0186941 | A1 | 8/2007 | Holton, Jr. et al. | |
| 2008/0173317 | A1* | 7/2008 | Robinson | B65D 81/266 131/112 |
| 2008/0196730 | A1 | 8/2008 | Engstrom et al. | |
| 2009/0025741 | A1 | 1/2009 | Crawford et al. | |
| 2009/0065013 | A1 | 3/2009 | Essen et al. | |
| 2011/0041860 | A1 | 2/2011 | Essen et al. | |
| 2012/0067361 | A1 | 3/2012 | Bjorkholm et al. | |
| 2012/0141648 | A1 | 6/2012 | Morton et al. | |
| 2012/0199145 | A1 | 8/2012 | Byrd et al. | |
| 2013/0206153 | A1* | 8/2013 | Beeson | A24B 15/24 131/297 |
| 2013/0276801 | A1* | 10/2013 | Byrd, Jr. | A24B 15/241 131/297 |
| 2016/0073686 | A1 | 3/2016 | Crooks | |
| 2016/0227834 | A1 | 8/2016 | Byrd, Jr. et al. | |
| 2017/0020183 | A1* | 1/2017 | Bjorkholm | A23G 4/08 |
| 2017/0112183 | A1 | 4/2017 | Bjorkholm | |
| 2017/0112889 | A1 | 4/2017 | Spencer et al. | |

FOREIGN PATENT DOCUMENTS

| | | | |
|---|---|---|---|
| CA | 2796346 | A1 | 10/2011 |
| CA | 2942241 | A1 | 10/2015 |
| CN | 103327840 | A | 9/2013 |
| CN | 104532662 | A | 4/2015 |
| EP | 0075128 | A2 | 3/1983 |
| EP | 0215682 | A2 | 3/1987 |
| EP | 0336894 | A1 | 10/1989 |
| EP | 0514805 | A2 | 11/1992 |
| JP | H0213350 | A | 1/1990 |
| JP | H0769902 | A | 3/1995 |
| JP | 2000344661 | A | 12/2000 |
| JP | 2003516723 | A | 5/2003 |
| JP | 2007515950 | A | 6/2007 |
| JP | 2008541727 | A | 11/2008 |
| JP | 2009508523 | A | 3/2009 |
| JP | 2009525315 | A | 7/2009 |
| JP | 2012522765 | A | 9/2012 |
| JP | 2013524788 | A | 6/2013 |
| JP | 2013544522 | A | 12/2013 |
| JP | 2013544523 | A | 12/2013 |
| JP | 2016536982 | A | 12/2016 |
| SE | 529866 | C2 | 12/2007 |
| WO | WO-9815191 | A1 | 4/1998 |
| WO | WO-0128367 | A1 | 4/2001 |
| WO | WO-2005046363 | A2 | 5/2005 |
| WO | WO-2005064074 | A2 | 7/2005 |
| WO | WO-2006127772 | A2 | 11/2006 |
| WO | WO-2007053096 | A1 | 5/2007 |
| WO | WO-2007053097 | A1 | 5/2007 |
| WO | WO-2007073346 | A1 | 6/2007 |
| WO | WO-2007126361 | A1 | 11/2007 |
| WO | WO-2007138484 | A2 | 12/2007 |
| WO | WO-2008016520 | A2 | 2/2008 |
| WO | WO-2008042331 | A2 | 4/2008 |
| WO | WO-2008056363 | A2 | 5/2008 |

(Continued)

OTHER PUBLICATIONS

Abstract of ISO 2470:1999: Paper, board and pulps—Measurement of diffuse blue reflectance factor (ISO brightness), 2 pages.
Office Action dated Jun. 2, 2020 for Japanese Application No. 2019-061519, 11 pages.
Office Action dated May 5, 2020 for Canadian Application No. 3038326, 4 pages.
Application and File History for U.S. Appl. No. 13/262,529, filed Dec. 7, 2011, Inventors: Bjorkholm et al.
Application and File History for U.S. Appl. No. 15/284,593, filed Oct. 4, 2016, inventor: Bjorkholm.
Application and File History for U.S. Appl. No. 15/301,724, filed Oct. 4, 2016, inventor: Bjorkholm.
Extended Search Report dated Mar. 13, 2019 for European Application No. 18200200.6, 7 pages.

(Continued)

*Primary Examiner* — Michael H. Wilson
*Assistant Examiner* — Stephanie Lynn Moore
(74) *Attorney, Agent, or Firm* — Patterson, Thuente PA

(57) ABSTRACT

The invention provides a smokeless tobacco composition that contains bleached tobacco material and guar gum.

18 Claims, No Drawings

(56) References Cited

FOREIGN PATENT DOCUMENTS

| | | | |
|---|---|---|---|
| WO | WO-2009010884 | A2 | 1/2009 |
| WO | WO-2009015142 | A2 | 1/2009 |
| WO | WO-2010114445 | A1 | 10/2010 |
| WO | WO-2011130414 | A1 | 10/2011 |
| WO | WO-2012074985 | A1 | 6/2012 |
| WO | WO-2012075035 | A2 | 6/2012 |
| WO | WO-2012134380 | A1 | 10/2012 |
| WO | WO-2014166845 | A1 | 10/2014 |
| WO | WO-2015057603 | A1 | 4/2015 |
| WO | WO-2015150506 | A1 | 10/2015 |
| WO | WO-2015167430 | A1 | 11/2015 |
| WO | WO-2016097294 | A1 | 6/2016 |
| WO | WO-2018083114 | A1 | 5/2018 |

OTHER PUBLICATIONS

International Preliminary Report on Patentability for Application No. PCT/EP2015/057278, dated Oct. 13, 2016, 7 pages.

International Search Report and Written Opinion for Application No. PCT/EP2015/057278, dated Jun. 15, 2015, 8 pages.

International Preliminary Report on Patentability for Application No. PCT/EP2017/077955, dated Oct. 9, 2018, 7 pages.

International Search Report and Written Opinion for Application No. PCT/EP2017/077955, dated Jan. 23, 2018, 14 pages.

International Search Report and Written Opinion for Application No. PCT/SE2009/050354, dated Dec. 3, 2009, 12 pages.

IS01762: 2001 Paper, board and pulps—Determination of residue (ash) on ignition at 5250C, 3 pages.

IS05267-1: 1999 Pulps—Determination of drainability—Part 1: Schopper-Riegler method, 6 pages.

Kajita et al., "Improvements in pulping and leaching properties of xylem from transgenic tobacco plants," In J Sci Food Agric, 2002, vol. 82, pp. 1216-1223.

Leffingwell, "Leaf Chemistry BA Basic Constituents of Tobacco Leaf and Differences among Tobacco Types", Blackwell Science (Pub), Jan. 1, 1999) XP055326787. Retrieved from the Internet: URL: http: www.leffingwell.com/download/Leffingwell- Tobacco production chemistry and technology.pdf.

Office Action dated Apr. 3, 2018 for Japanese Application No. 2016-553626, 5 pages (9 pages with translation).

Office Action dated Sep. 10, 2013 for Japanese Application No. 2012-503359, 9 pages.

Office Action dated Dec. 19, 2018 for Swedish Application No. SE1651447-3, 20 pages.

Office Action dated Apr. 20, 2018 for Swedish Application No. SE1651447-3, 4 pages.

Office Action dated May 31, 2017 for Swedish Application No. SE1651447-3, 9 pages.

Office Action with English Translation dated Dec. 21, 2015 corresponding to Japanese Patent Application No. 2015-018223, 8 pages.

Shakhes et al., "Tobacco residuals as promising lignocellulosic materials for pulp and paper industry", in Tobacco fibers for paper, 2011, BioResources, vol. 6 (4), pp. 4481-4493.

Shi et al., "Effects of Food Gums on Viscosities of Starch Suspension During Pasting" Carbohydrate Polymers, Applied Science Publishers, Ltd., Barking, GB, (2002), vol. 50, No. 1, pp. 7-18.

Talhout R et al., "Sugars as tobacco ingredient: Effects on mainstream smoke composition 2," Food and Chemical Toxicology, Nov. 1, 2006, vol. 44, No. 11, pp. 1789-1798.

* cited by examiner

SMOKELESS TOBACCO COMPOSITION

The present invention relates to a smokeless tobacco composition, and to a process for producing the smokeless tobacco composition.

BACKGROUND

Tobacco fermentation is basically a process that starts spontaneously soon after the tobacco is harvested. As tobacco fermentation was early on found to enhance certain properties of the tobacco, such as smell and taste, this spontaneous process is frequently consciously stimulated in various industrial processes in the course of tobacco production.

However, tobacco fermentation—spontaneous as well as industrially stimulated—also has the effect of generating undesired byproducts, such as for instance tobacco-specific nitrosamines, abbreviated TSNA.

US20130276801 describes chemical pulping of tobacco and bleaching the tobacco pulp to produce a dissolving grade pulp. Bleaching the tobacco pulp may include chlorination of the tobacco pulp with a chlorine dioxide solution, and caustic extraction of the tobacco pulp with a second strong base. Carbohydrate content is not suggested to be reduced or limited, but on the contrary to be protected during the treatments. Fermentation is not discussed in the document.

It would be desirable to be able to provide an improved smokeless tobacco composition. For example, it would be desirable to provide a smokeless tobacco composition that can easily be provided with such desirable properties as is associated with tobacco fermentation, such as enhanced smell and taste, while not being burdened by the undesired side effects of tobacco fermentation. It would also be desirable to provide a smokeless tobacco composition having improved physical properties to enhance the user's experience.

SUMMARY OF THE INVENTION

In accordance with some embodiments described herein, there is provided a smokeless tobacco composition comprising bleached tobacco material and guar gum.

In accordance with some embodiments described herein, there is provided a process for the production of a smokeless tobacco composition as defined herein, the process comprising:

(a) providing the bleached tobacco material; and (b) contacting the bleached tobacco material with guar gum to produce the smokeless tobacco composition.

In accordance with some embodiments described herein, there is provided a smokeless tobacco composition obtained or obtainable by the process comprising:

(a) providing the bleached tobacco material; and (b) contacting the bleached tobacco material with guar gum to produce the smokeless tobacco composition.

For ease of reference, these and further aspects of the present invention are now discussed under appropriate section headings. However, the teachings under each section are not necessarily limited to each particular section.

DETAILED DESCRIPTION

It is to be understood that this invention is not limited to the particular configurations, process steps, and materials disclosed herein as such configurations, process steps, and materials may vary somewhat. It is also to be understood that the terminology employed herein is used for the purpose of describing particular embodiments only and is not intended to be limiting since the scope of the present invention will be limited only by the appended claims and equivalents thereof.

It must be noted that, as used in this specification and the claims, the singular forms "a," "an," and "the" include plural referents unless the context clearly dictates otherwise.

In this specification, unless otherwise stated, the term "about" modifying the quantity of an ingredient in the tobacco material or tobacco compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the tobacco material or tobacco compositions, or to carry out the methods; and the like. The term "about" also encompasses amounts that differ due to different equilibrium conditions for a composition resulting from a particular initial mixture. Whether or not modified by the term "about," the claims include equivalents to the quantities.

In this specification, unless otherwise stated, the term "bleached" refers to an object, such as for instance a tobacco material, such as a tobacco raw material, whose visible color has been reduced by any known method for this purpose, such as washing with one or more solvents, or treatment with one or more bleaching agents, or any combination thereof.

In this specification, unless otherwise stated, the term "fermentable carbohydrates" refers to carbohydrates that can be metabolically broken down in and by the human body. For example, the term "fermentable carbohydrate" may encompass starch, glucose, fructose and sucrose.

In this specification, unless otherwise stated, the term "oral" in connection to a product refers to a product which, in normal use, is suited to be placed somewhere in the oral cavity of the user, for example under the lips, in the same way as moist snuff products are generally used.

The ranges provided herein provide preferred amounts of each of the components. Each of these ranges may be taken alone or combined with one or more other component ranges to provide a preferred aspect of the invention.

Composition

As described herein, the smokeless tobacco composition comprises bleached tobacco material and guar gum.

In some embodiments, the bleached tobacco material is a bleached tobacco raw material.

In some embodiments, the bleached tobacco material is present in an amount of from about 0.001% to about 15% by weight of the smokeless tobacco composition. In some embodiments, the bleached tobacco material is present in an amount of from about 0.01% to about 10% by weight of the smokeless tobacco composition. In some embodiments, the bleached tobacco material is present in an amount of from about 0.01% to about 7.5% by weight of the smokeless tobacco composition. In some embodiments, the bleached tobacco material is present in an amount of from about 0.05% to about 5% by weight of the smokeless tobacco composition. In some embodiments, the bleached tobacco material is present in an amount of from about 0.05% to about 2.5% by weight of the smokeless tobacco composition. In some embodiments, the bleached tobacco material is present in an amount of from about 0.05% to about 2% by weight of the smokeless tobacco composition. In some embodiments, the bleached tobacco material is present in an amount of from about 0.1% to about 1% by weight of the smokeless tobacco composition. In some embodiments, the bleached tobacco material is present in an amount of from about 0.1% to about 0.5% by weight of the smokeless tobacco composition.

In some embodiments, the bleached tobacco material is present in an amount of from about 0.01% to about 5% by weight of the smokeless tobacco composition.

In some embodiments, the bleached tobacco material is as described in WO 2015/150506, the entire contents of which are incorporated herein by reference.

In some embodiments, the bleached tobacco material comprises less than about 4 weight-%, such as less than about 2 weight-%, such as less than about 1 weight-%, of fermentable carbohydrates, calculated on the dry total weight of the bleached tobacco material.

In some embodiments, the bleached tobacco material has an ISO brightness that is not less than about 60, such as not less than about 70, such as not less than about 80, as measured according to ISO 2470:1999.

In some embodiments, the present invention provides a smokeless tobacco composition that comprises a tobacco material (such as a tobacco raw material) that is substantially free from undesired substances, as described in WO 2015/150506.

In some embodiments, the bleached tobacco material is particulate. As used herein, the term "particulate" means that the average length to width ratio of particles of the material is less than 2:1, such as less than 1.5:1, such as about 1:1. In some embodiments the particles of the bleached tobacco material are substantially spherical. In some embodiments, the bleached tobacco material is granular.

In some embodiments, at least 50% by weight of the bleached tobacco particles have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 60% by weight of the bleached tobacco particles have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 70% by weight of the bleached tobacco particles have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 80% by weight of the bleached tobacco particles have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 90% by weight of the bleached tobacco particles have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 95% by weight of the bleached tobacco particles have a particle size as measured by sieve analysis of no greater than about 1000 μm, such as no greater than about 500 μm, such as no greater than about 400 μm, such as no greater than about 350 μm, such as no greater than about 300 μm. In some embodiments, at least 99% by weight of the bleached tobacco particles have a particle size as measured by sieve analysis of no greater than about 1000 μm, such as no greater than about 500 μm, such as no greater than about 400 μm, such as no greater than about 350 μm, such as no greater than about 300 μm. In some embodiments, approximately 100% by weight of the bleached tobacco particles have a particle size as measured by sieve analysis of no greater than about 1000 μm, such as no greater than about 500 μm, such as no greater than about 400 μm, such as no greater than about 350 μm, such as no greater than about 300 μm.

In some embodiments, at least 50% by weight, such as at least 60% by weight, such as at least 70% by weight, such as at least 80% by weight, such as at least 90% by weight, such as at least 95% by weight, such as at least 99% by weight of the bleached tobacco particles have a particle size as measured by sieve analysis of from about 0.01 μm to about 1000 μm, such as from about 0.05 μm to about 750 μm, such as from about 0.1 μm to about 500 μm, such as from about 0.25 μm to about 500 μm. In some embodiments, at least 50% by weight, such as at least 60% by weight, such as at least 70% by weight, such as at least 80% by weight, such as at least 90% by weight, such as at least 95% by weight, such as at least 99% by weight of the bleached tobacco particles have a particle size as measured by sieve analysis of from about 10 μm to about 400 μm, such as from about 50 μm to about 350 μm, such as from about 100 μm to about 350 μm, such as from about 200 μm to about 300 μm.

In some embodiments, at least 70% of the bleached tobacco particles have a particle size as measured by sieve analysis of from about 0.01 μm to about 1000 μm, such as from about 10 μm to about 500 μm, such as from about 100 μm to about 350 μm, such as from about 200 μm to about 350 μm. In some embodiments, at least 90% of the bleached tobacco particles have a particle size as measured by sieve analysis of from about 0.01 μm to about 1000 μm, such as from about 10 μm to about 500 μm, such as from about 100 μm to about 350 μm, such as from about 200 μm to about 350 μm. In some embodiments, at least 95% of the bleached tobacco particles have a particle size as measured by sieve analysis of from about 0.01 μm to about 1000 μm, such as from about 10 μm to about 500 μm, such as from about 100 μm to about 350 μm, such as from about 200 μm to about 350 μm. In some embodiments, at least 99% of the bleached tobacco particles have a particle size as measured by sieve analysis of from about 0.01 μm to about 1000 μm, such as from about 10 μm to about 500 μm, such as from about 100 μm to about 350 μm, such as from about 200 μm to about 350 μm.

The particle size of the bleached tobacco material may be measured by sieve analysis. As the skilled person will readily appreciate, sieve analysis (otherwise known as a gradation test) is a method used to measure the particle size distribution of a particulate material. Typically, sieve analysis involves a nested column of sieves which comprise screens, preferably in the form of wire mesh cloths. A pre-weighed sample may be introduced into the top or uppermost sieve in the column, which has the largest screen openings or mesh size (i.e. the largest pore diameter of the sieve). Each lower sieve in the column has progressively smaller screen openings or mesh sizes than the sieve above. Typically, at the base of the column of sieves is a receiver portion to collect any particles having a particle size smaller than the screen opening size or mesh size of the bottom or lowermost sieve in the column (which has the smallest screen opening or mesh size).

In some embodiments, the column of sieves may be placed on or in a mechanical agitator. The agitator causes the vibration of each of the sieves in the column. The mechanical agitator may be activated for a pre-determined period of time in order to ensure that all particles are collected in the correct sieve. In some embodiments, the column of sieves is agitated for a period of time from 0.5 minutes to 10 minutes, such as from 1 minute to 10 minutes, such as from 1 minute to 5 minutes, such as for approximately 3 minutes.

Once the agitation of the sieves in the column is complete, the material collected on each sieve is weighed. The weight of each sample on each sieve may then be divided by the total weight in order to obtain a percentage of the mass retained on each sieve.

As the skilled person will readily appreciate, the screen opening sizes or mesh sizes for each sieve in the column used for sieve analysis may be selected based on the granularity or known maximum/minimum particle sizes of the sample to be analysed.

In some embodiments, a column of sieves may be used for sieve analysis, wherein the column comprises from 2 to 20 sieves, such as from 5 to 15 sieves. In some embodiments, a column of sieves may be used for sieve analysis, wherein the column comprises 10 sieves. In some embodiments, the largest screen opening or mesh sizes of the sieves used for sieve analysis may be 1000 μm, such as 500 μm, such as 400 μm, such as 300 μm.

In some embodiments, the guar gum is present in an amount of from about 0.01% to about 20% by weight of the smokeless tobacco composition. In some embodiments, the guar gum is present in an amount of from about 0.1% to about 15% by weight of the smokeless tobacco composition. In some embodiments, the guar gum is present in an amount of from about 0.5% to about 10% by weight of the smokeless tobacco composition. In some embodiments, the guar gum is present in an amount of from about 1% to about 10% by weight of the smokeless tobacco composition. In some embodiments, the guar gum is present in an amount of from about 2% to about 8% by weight of the smokeless tobacco composition. In some embodiments, the guar gum is present in an amount of from about 2.5% to about 7.5% by weight of the smokeless tobacco composition. In some embodiments, the guar gum is present in an amount of from about 3% to about 7% by weight of the smokeless tobacco composition. In some embodiments, the guar gum is present in an amount of from about 4% to about 6% by weight of the smokeless tobacco composition.

It has been surprisingly found by the present inventors that the inclusion of guar gum with a bleached tobacco material provides a smokeless tobacco composition which is mouldable. As used herein, the term "mouldable" means that the composition can be pushed and formed into different shapes by the user's hands, without requiring any additional mechanical means and without cracking and/or crumbling. In particular, a smokeless tobacco composition may be provided which has a soft dough-like texture, and/or which can be moulded by the user into any desired shape. This mouldability was not previously achieved by smokeless tobacco compositions comprising bleached tobacco material, but which did not include guar gum. It was also surprisingly found by the present inventors that hydrocolloids other than guar gum did not provide the composition with the desired mouldability.

In some embodiments, the smokeless tobacco composition may be provided in the form of a loose powder. However, due to the inclusion of the guar gum, it was surprisingly found by the present inventors that it was possible for the user to take a 'pinch' of the powder and press it together using their hands so as to form a soft dough-like portion, which can be moulded into different shapes. The composition therefore provides the user with an enhanced experience and desirable sensory experience upon picking up the product to place into the oral/nasal cavity.

One advantage of the smokeless tobacco composition comprising the bleached tobacco material as defined herein is that it provides for tobacco products that does not discolour the user's fingers, and—in the case of oral smokeless tobacco products—does not discolour the user's teeth.

In some embodiments, the smokeless tobacco composition is nasal snuff, i.e. snuff products suited for nasal administration. Therefore, in some embodiments, there is provided a nasal snuff which comprises bleached tobacco material and guar gum.

In some embodiments, the smokeless tobacco composition is an oral smokeless tobacco composition (i.e. one which is suitable for placing into the mouth of the user). Therefore, in some embodiments, there is provided an oral smokeless tobacco composition comprising bleached tobacco material and guar gum. The oral smokeless tobacco composition may be or comprise, but is not limited to, moist snuff such as snus, chewing tobacco, sucking tobacco (commonly referred to as "lutsch-tabak"), oral dry snuff, or hard snuff.

In some embodiments, the oral smokeless tobacco composition comprises snus. The snus may be Swedish-style snuff. Snus is a moist powder tobacco product originating from a variant of dry snuff. Snus is typically used by placing it under the upper lip for extended periods of time.

In some embodiments, the oral smokeless tobacco composition is chewing tobacco comprising a gum base. The gum base may be chosen among—but is not limited to—commercial chewing gum bases, bubble gum bases, and natural gum base materials.

In some embodiments, the oral smokeless tobacco composition is sucking tobacco. Therefore, in some embodiments, the smokeless tobacco composition is a sucking tobacco composition that comprises bleached tobacco material and guar gum.

In some embodiments, the smokeless tobacco composition may comprise salt (sodium chloride) and/or other flavourants.

In some embodiments, the smokeless tobacco composition (such as an oral smokeless tobacco composition) further comprises one or more additives selected from the group consisting of sodium chloride, xylitol, microcrystalline cellulose, flavouring agents, sodium bicarbonate and mixtures thereof. In some embodiments, the smokeless tobacco composition further comprises sodium chloride. In some embodiments, the smokeless tobacco composition further comprises flavouring agents. In some embodiments, the smokeless tobacco composition further comprises xylitol. In some embodiments, the smokeless tobacco composition further comprises sodium bicarbonate. In some embodiments, the smokeless tobacco composition further comprises microcrystalline cellulose.

The oral smokeless tobacco composition may comprise additives chosen among—but not limited to—one or more substances belonging to any of the following categories, or combinations thereof: API (active pharmaceutical substances), food additives, natural or synthetic nutrients, flavoring substances, natural medicaments or naturally occurring substances that can have an effect on humans. Examples of such substances are green tea, white tea, caffeine, vitamin B12, vitamin C, vitamin E, bioperin, Q10, selenium, glutathione, liponic acid, folic acid, *ginseng*, pollen extract, antioxidants, minerals, paracetamol, acetylsalicylic acid, Russian root, and rose root.

In some embodiments, the oral smokeless tobacco composition further comprises nicotine in addition to the nicotine naturally present in the bleached tobacco material.

In some embodiments, the oral smokeless tobacco composition contains an alginate composition of the kind, and in the way described in WO 2010/114445, the contents of which is hereby incorporated by reference. More specifically, the oral smokeless tobacco composition according to this embodiment contains an alginate composition, distributed in the product and comprising at least water, alginate and an added substance intended to be released from the product when said product is used, said composition containing an alginate matrix that retains at least a major proportion of the added substance so long as the matrix is intact, and the alginate matrix being formed so as to disintegrate and/or dissolve in the chemical and physical environment that exists in a user's mouth. In some embodiments, the alginate contains an alginate salt of monovalent cations. In some embodiments, the alginate is soluble in cold water.

The oral smokeless tobacco composition may be provided in baked or compressed form, from which portions may be punched or pressed in portions, such as lozenges or tablets.

In some embodiments, the smokeless oral tobacco product can be provided to the user in a portioned format. In some embodiments, the smokeless tobacco composition is surrounded by a pouch. For example, moist snuff may be prepared by sealing the tobacco material in a permeable pouch.

A pouch holds the tobacco material in place, while at the same time allowing substances such as flavours and nicotine to diffuse through the pouch and into the mouth of the user for absorption through the user's mucous membranes.

In some embodiments, the smokeless tobacco composition can be provided to the user in a non-portioned format. In one embodiment, the smokeless tobacco composition is packaged in loose form in a container, such as a can, sachet or tin.

In some embodiments, the oral smokeless tobacco composition may be provided in loose form or in the form of portion-size sachets. In some embodiments, the oral smokeless tobacco composition is provided as a loose powder. In some embodiments, the oral smokeless tobacco composition is provided as a powder that is contained in a pouch. Therefore, in some embodiments, there is provided a pouched oral smokeless tobacco composition comprising bleached tobacco material and guar gum.

In some embodiments, the oral smokeless tobacco composition is in the form of a powder, either provided as a loose powder or in pouches. The oral smokeless tobacco composition may be particulate. In some embodiments, at least 50% of the particles of oral smokeless tobacco composition have a particle size of less than about 2000 μm, such as from about 0.01 μm to about 1000 μm, such as from about 0.1 to about 500 μm, such as from about 1 to about 400 μm, such as from about 10 μm to about 350 μm, such as from about 100 μm to about 350 μm, such as from about 200 μm to about 300 μm.

As a further alternative the oral smokeless tobacco composition may have a film-like form.

The smokeless tobacco composition may have a pH of about 7-12, such as about 8-12, such as about 8-9.

In some embodiments, the smokeless tobacco composition has a water content of from about 5% to about 60%, such as from about 20% to about 60%, such as from about 40 to about 55%, such as from about 45% to about 55%, such as from about 45% to about 50% by weight of the smokeless tobacco composition. In some embodiments, the smokeless tobacco composition has a water content of from about 40% to about 60% by weight of the smokeless tobacco composition.

Also described herein is a smokeless product, which comprises non-tobacco plant material and guar gum, but does not comprise tobacco. In other words, described herein is a smokeless non-tobacco product comprising non-tobacco plant material and guar gum. The non-tobacco plant material may be selected from the group consisting of maize, oat, tomato, barley, rye, sugar beet, buck wheat, potato, cellulose, cellulose derivatives, apple, cocoa, bamboo, citrus, and mixtures thereof. In some embodiments, the non-tobacco plant material is or comprises cellulose, microcrystalline cellulose, or mixtures thereof. In some embodiments, the non-tobacco plant material is or comprises microcrystalline cellulose. In some embodiments, the smokeless non-tobacco product comprises nicotine. Therefore, in some embodiments, the smokeless non-tobacco product comprises non-tobacco plant material, guar gum and nicotine. The smokeless non-tobacco product may comprise each of the features as described hereinabove, with the exception that said product does not comprise the bleached tobacco material as described herein.

Process

According to a further aspect of the invention, there is provided a process for the production of a smokeless tobacco composition which comprises:

(a) providing bleached tobacco material; and (b) contacting the bleached tobacco material with guar gum to produce the smokeless tobacco composition.

In some embodiments, the process is for the production of the smokeless tobacco composition as described hereinabove.

In some embodiments, the element (a) of providing the bleached tobacco material comprises:

(i) treating unbleached tobacco material at an acidic pH and at a temperature range of from about 70° C. to about 180° C. with an aqueous solution of comprising sulfite ion;

(ii) defibrating the tobacco material from element (i); and (iii) treating the defibrated tobacco material from element (ii) with an effective amount of a bleaching agent at a temperature range of from about 60° C. to about 90° C.

The bleaching agent may be, but is not limited to, chlorine dioxide, sodium hypochlorite, hydrogen peroxide, ozone, enzymes, oxygen, or a combination thereof.

The bleaching agent may also be constituted by, or at least involve the use of ultrasound.

In some embodiments, the element (a) of providing the bleached tobacco material comprises steps as described in WO 2015/150506, the entire contents of which are incorporated herein by reference.

In some embodiments, the element (a) of providing the bleached tobacco material comprises:

(i) mechanically defibrating uncooked tobacco material to produce a defibrated tobacco material; and (ii) treating the defibrated tobacco material from element (i) with at least one bleaching agent to product a bleached tobacco material.

In some embodiments, providing the bleached tobacco material comprises elements as described in WO 2018/083114, the entire contents of which are incorporated herein by reference.

In some embodiments, the process further comprises contacting the bleached tobacco material and/or the guar gum with one or more additives selected from the group consisting of sodium chloride, xylitol, microcrystalline cellulose, flavouring agents, sodium bicarbonate, API (active pharmaceutical substances), nicotine, food additives, natural or synthetic nutrients, natural medicaments or naturally occurring substances that can have an effect on humans and mixtures thereof. In some embodiments, the process comprises contacting the bleached tobacco material with one or more additives before and/or during and/or after contacting the bleached tobacco material with guar gum. In some embodiments, the process comprises contacting the bleached tobacco material with one or more additives before contacting the bleached tobacco material with guar gum. In some embodiments, the process comprises contacting the bleached tobacco material with one or more additives during contacting the bleached tobacco material with guar gum. In some embodiments, the process comprises contacting the bleached tobacco material with one or more additives after contacting the bleached tobacco material with guar gum.

In some embodiments, the process comprises contacting the bleached tobacco material with one or more additives selected from the group consisting of sodium chloride, microcrystalline cellulose, and mixtures thereof during the element (b) of contacting the bleached tobacco material with guar gum. In some embodiments, the process comprises contacting the bleached tobacco material with one or more additives selected from the group consisting of sodium bicarbonate, flavouring agents, nicotine, and mixtures thereof after the element (b) (contacting the bleached tobacco material with guar gum).

In some embodiments, the process further comprises contacting the bleached tobacco material with water. In some embodiments, the process further comprises contacting the bleached tobacco material with water before and/or during and/or after the element (b) (contacting the bleached tobacco material with guar gum). In some embodiments, the process comprises contacting the bleached tobacco material with water before contacting the bleached tobacco material with guar gum. In some embodiments, the process comprises contacting the bleached tobacco material with water during contacting the bleached tobacco material with guar gum. In some embodiments, the process comprises contacting the bleached tobacco material with water after contacting the bleached tobacco material with guar gum.

Another aspect disclosed herein relates to a smokeless tobacco composition obtained or obtainable by the inventive processes within the scope of this disclosure. In some embodiments, a smokeless tobacco composition is obtained or obtainable by the processes described hereinabove, wherein the smokeless tobacco composition comprises bleached tobacco material and guar gum. In some embodiments, the smokeless tobacco composition comprises bleached tobacco material that comprises less than about 4 weight-% fermentable carbohydrates, calculated on the dry total weight of the bleached tobacco material.

In some embodiments, the smokeless tobacco composition is as described in any one of the embodiments described above.

Several embodiments of the invention will now be illustrated in closer detail in the following non-limiting examples.

EXAMPLES

Example 1

Digestion

Step 1

Unbleached tobacco raw material was cooked with water in a digesting vessel at 120° C. for 30 minutes, after which the liquid was drawn off, and the material was flushed with water.

Step 2

Cooking liquor, with pH adjusted to 4.5 by $SO_2$, was added to the digesting vessel. The cooking liquor contained mainly sodium bisulfite, but also partly sodium sulfite. The cooking was performed at 165° C. for 40 minutes, after which the digesting vessel was degassed. Water was added and circulated at 80° C. The digesting vessel was emptied and the material was flushed.

Screening

The digested material was taken to a defibrator, in which the fibres were freed by beating.

The obtained fiber suspension was led to a screen with 0.25 mm slots to screen away undigested fibres. The remaining fibres were brought to a centrifuge in which the material, pulp, was dewatered to dry content of about 30%.

Bleaching

The bleaching was carried out in a plastic vessel heated by a water bath.

Step 1

The pulp was treated at 70° C. for 30 minutes with $ClO_2$ in an amount of 38 kg/ton of pulp, at a pulp concentration of 10%.

Step 2

The pulp was treated at 80° C. for 120 minutes with $ClO_2$ in an amount of 38 kg/ton of pulp, at a pulp concentration of 10%.

Step 3

The pulp was treated at 80° C. for 120 minutes with $ClO_2$ in an amount of 19 kg/ton of pulp, at a pulp concentration of 10%.

The pulp was washed after each step according to the following:

Bleaching liquor was drawn off in a centrifuge; the pulp was diluted with water and slurried by means of a stirrer; and the pulp was then washed in the centrifuge with 1 liter of water per 10 grams of pulp.

Analysis

The resulting pulp was analyzed at Eurofins Food & Agro Testing Norway AS (Skansen), in Trondheim, Norway, with respect to the content of starches and simple sugars, which proved to be <1.0%.

The pulp was also analyzed at Eurofins Food & Agro Testing Sweden AB, Lidkoping, Sweden, with respect to the content of sucrose, which proved to be <0.04 g/100 g, i.e. <0.04%.

Thus, the total content of fermentable carbohydrates was <1.04%.

The pulp was also analyzed at Eurofins Food & Agro Testing Sweden AB with respect to the content of nitrite, which proved to be <1.0 mg/kg.

The pulp was also analyzed at Eurofins Food & Agro Testing Sweden AB with respect to the combined amount of NNN (N-nitrosonornicotine) and NNK ((4-methylnitrosamino)-1-(3-pyridyl)-1-butanone), which proved to be <0.020 mg/kg.

The pulp was also analyzed at Eurofins Food & Agro Testing Sweden AB with respect to the content of NDMA (N-Nitrosodimethylamine), which proved to be <0.20 μg/kg.

The pulp was also analyzed at Eurofins Food & Agro Testing Sweden AB with respect to the content of B(a)P (Benzo(a)pyrene) which proved to be <1.0 μg/kg.

The pulp was also analyzed at Eurofins Environment Sweden, Lidkoping, Sweden, with respect to the content of Cd, which proved to be 0.063 mg/kg±20% (analysis method/reference NMKL No 161 1998 mod).

The pulp was also analyzed at Eurofins Environment Sweden, Lidkoping, Sweden, with respect to the content of Pb, which proved to be 0.63 mg/kg±20% (analysis method/reference NMKL No 161 1998 mod).

The pulp was also analyzed at Eurofins Environment Sweden, Lidkoping, Sweden, with respect to the content of As, which proved to be <0.050 mg/kg±35% (analysis method/reference NMKL No 161 1998 mod).

The pulp was also analyzed at Eurofins Environment Sweden, Lidkoping, Sweden, with respect to the content of Ni, which proved to be 0.63 mg/kg±25% (analysis method/reference NMKL No 161 1998 mod).

The pulp was also analyzed at Eurofins Environment Sweden, Lidkoping, Sweden, with respect to the content of Cr, which proved to be 1.5 mg/kg±20% (analysis method/reference NMKL No 161 1998 mod).

Example 2

A smokeless tobacco composition was prepared using the bleached tobacco material of Example 1.

A smokeless tobacco composition having the following formula was prepared:

| Ingredient | % by weight |
|---|---|
| Water | 55 |
| Microcrystalline cellulose | 34 |
| Bleached tobacco material of Example 1 | 0.5 |
| Sodium chloride | 4 |
| Guar gum | 4 |
| Nicotine | 1 |
| Sodium alginate | 0.5 |
| Flavouring agent | 0.5 |
| Sodium bicarbonate | 0.5 |

The composition was prepared using the following method:

1. The bleached tobacco material is mixed with microcrystalline cellulose, sodium chloride, sodium alginate and guar gum, and the resulting tobacco mixture introduced into a blender.

2. In a separate container, sodium bicarbonate is mixed with water. The mixture is stirred until the sodium bicarbonate fully dissolves to form an aqueous solution.

3. The sodium bicarbonate solution is then added to the tobacco mixture from step 1, and blended for about 5 minutes.

4. In a separate container, flavouring agents and nicotine are mixed together.

These are then added to the tobacco mixture from step 3, and blended for about 10 minutes.

5. The resulting mixture is then removed from the blender and placed into storage containers It is found that the smokeless tobacco composition could be pushed and pressed into different shapes by the user's hands without cracking or crumbling. The product when pushed into shape has a soft dough-like texture, and is readily mouldable.

The various embodiments described herein are presented only to assist in understanding and teaching the claimed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the invention as defined by the claims or limitations on equivalents to the claims, and that other embodiments may be utilised and modifications may be made without departing from the scope of the claimed invention. Various embodiments of the invention may suitably comprise, consist of, or consist essentially of, appropriate combinations of the disclosed elements, components, features, parts, steps, means, etc, other than those specifically described herein. In addition, this disclosure may include other inventions not presently claimed, but which may be claimed in future.

The invention claimed is:

1. A smokeless tobacco composition comprising bleached tobacco material and guar gum, and wherein the smokeless tobacco composition is surrounded by a pouch.

2. The smokeless tobacco composition according to claim 1, wherein the bleached tobacco material is present in an amount of from about 0.001% to about 15% by weight of the smokeless tobacco composition.

3. The smokeless tobacco composition according to claim 1, wherein the bleached tobacco material is present in an amount of from about 0.01% to about 10% by weight of the smokeless tobacco composition.

4. The smokeless tobacco composition according to claim 1, wherein the guar gum is present in an amount of from about 0.1% to about 15% by weight of the smokeless tobacco composition.

5. The smokeless tobacco composition according to claim 1, wherein the guar gum is present in an amount of from about 1% to about 10% by weight of the smokeless tobacco composition.

6. The smokeless tobacco composition according to claim 1, wherein the bleached tobacco material comprises less than about 4 weight-% fermentable carbohydrates, calculated on the dry total weight of the bleached tobacco material.

7. The smokeless tobacco composition according to claim 1, wherein the bleached tobacco material comprises less than about 1 weight-% fermentable carbohydrates, calculated on the dry total weight of the bleached tobacco material.

8. The smokeless tobacco composition according claim 1, wherein the bleached tobacco material has an ISO brightness that is not less than about 60.

9. The smokeless tobacco composition according to claim 1, wherein the smokeless tobacco composition comprises water in an amount of from about 40% to about 60% by weight of the smokeless tobacco composition.

10. The smokeless tobacco composition according to claim 1, wherein the smokeless tobacco composition comprises nicotine in addition to any nicotine naturally present in the tobacco material.

11. The smokeless tobacco composition according to claim 1, wherein the composition is an oral smokeless tobacco composition.

12. The smokeless tobacco composition according to claim 11, wherein the oral smokeless tobacco composition is chewing tobacco, oral dry snuff, hard snuff or moist snuff such as snus.

13. The smokeless tobacco composition according to claim 11, wherein the composition contains an alginate composition, distributed in the product and comprising at least water, alginate and an added substance intended to be released from the product when said product is used, said alginate composition containing an alginate matrix that retains at least a major proportion of the added substance so long as the matrix is intact, and the alginate matrix being formed so as to disintegrate and/or dissolve in the chemical and physical environment that exists in a user's mouth.

14. The smokeless tobacco composition according to claim 11, wherein the composition is chewing tobacco comprising a gum base.

15. The smokeless tobacco composition according to claim 14, where the gum base is chosen among commercial chewing gum bases, bubble gum bases, and natural gum base materials.

16. A process for the production of a smokeless tobacco composition as defined in claim 1, the process comprising:

providing the bleached tobacco material; and contacting the bleached tobacco material with guar gum to produce the smokeless tobacco composition.

17. The process according to claim 16, wherein providing the bleached tobacco material comprises:

(i) treating unbleached tobacco material at an acidic pH and at a temperature range of from about 70° C. to about 180° C. with an aqueous solution of comprising sulfite ion;

(ii) defibrating the tobacco material from (i); and (iii) treating the defibrated tobacco material from (ii) with an effective amount of a bleaching agent at a temperature range of from about 60° C. to about 90° C.

18. A smokeless tobacco composition obtained or obtainable by the process according to claim 16.

* * * * *